US009440444B2

(12) United States Patent
Hatfield et al.

(10) Patent No.: US 9,440,444 B2
(45) Date of Patent: Sep. 13, 2016

(54) LIQUID MANAGEMENT SYSTEM

(71) Applicant: The Technology Partnership Plc., Royston, Hertfordshire (GB)

(72) Inventors: Stuart Hatfield, Cambridge (GB); Peter James Brown, Cambridge (GB); Andrew Victor Polijanczuk, Hemingford Grey (GB)

(73) Assignee: The Technology Partnership PLC (GB)

( * ) Notice: Subject to any disclaimer, the term of this patent is extended or adjusted under 35 U.S.C. 154(b) by 0 days.

(21) Appl. No.: 14/408,734

(22) PCT Filed: Jun. 28, 2013

(86) PCT No.: PCT/GB2013/051717

§ 371 (c)(1),
(2) Date: Dec. 17, 2014

(87) PCT Pub. No.: WO2014/001816

PCT Pub. Date: Jan. 3, 2014

(65) Prior Publication Data

US 2015/0202877 A1 Jul. 23, 2015

(30) Foreign Application Priority Data

Jun. 29, 2012 (GB) ..... 1211573.9

(51) Int. Cl.
*B41J 2/175* (2006.01)
*B41J 2/19* (2006.01)

(52) U.S. Cl.
CPC ..... *B41J 2/175* (2013.01); *B41J 2/17513* (2013.01); *B41J 2/17556* (2013.01)

(58) Field of Classification Search
CPC ..... B41J 2/175; B41J 2/18; B41J 2/17509; B41J 2/17556; B41J 2/17596; B41J 2/19
USPC ..... 347/7, 84, 85, 86, 87
See application file for complete search history.

(56) References Cited

U.S. PATENT DOCUMENTS

| | | | | |
|---|---|---|---|---|
| 4,163,723 | A * | 8/1979 | Romano et al. | 210/319 |
| 5,858,252 | A * | 1/1999 | Darcy | 210/788 |
| 6,698,869 | B2 * | 3/2004 | Vosahlo | B41J 2/175 347/7 |
| 7,182,449 | B2 * | 2/2007 | Inoue | B41J 2/19 347/85 |
| 7,543,923 | B2 * | 6/2009 | McNestry | B41J 2/16523 347/85 |
| 7,874,656 | B2 * | 1/2011 | Ota | B41J 2/17556 347/85 |
| 8,322,832 | B2 * | 12/2012 | Emerton et al. | 347/85 |

(Continued)

FOREIGN PATENT DOCUMENTS

| | | |
|---|---|---|
| EP | 0778145 | 11/1997 |
| EP | 1071559 | 10/1999 |
| EP | 1092548 | 4/2001 |

(Continued)

*Primary Examiner* — Ahn T. N. Vo
(74) *Attorney, Agent, or Firm* — Tarolli, Sundheim, Covell & Tummino LLP

(57) ABSTRACT

A liquid management system for supplying or receiving liquid at a controlled pressure, comprising: a closed reservoir having an inlet for receiving liquid from a first remote location and an outlet for supplying liquid to a second remote location; and a pumped outlet disposed in the reservoir and arranged to remove liquid and gas contained within the reservoir, the pumped outlet being disposed such that the level of liquid in the reservoir can be maintained at a constant height.

20 Claims, 6 Drawing Sheets

(56) References Cited

U.S. PATENT DOCUMENTS

| | | | | |
|---|---|---|---|---|
| 8,444,259 | B2 * | 5/2013 | Bennett | 347/89 |
| 2010/0295905 | A1 | 11/2010 | Tamaki | |

FOREIGN PATENT DOCUMENTS

| | | |
|---|---|---|
| EP | 1224079 | 5/2001 |
| EP | 1234673 | 8/2002 |
| EP | 1270238 | 1/2003 |
| EP | 1366901 | 12/2003 |
| EP | 2076395 | 3/2008 |
| WO | 2006018617 | 2/2006 |
| WO | 2006030235 | 3/2006 |
| WO | 2008035120 | 3/2008 |

* cited by examiner

LIQUID MANAGEMENT SYSTEM

TECHNICAL FIELD

The present invention relates to a liquid management system for supplying or receiving liquid at a controlled pressure, typically for use in devices such as a drop-on-demand printer or a spray head for use in aerosol generation, coating or the like.

BACKGROUND

In particular, the present invention relates to a liquid management system that enables the pressure of the supplied liquid to be controlled in order to, for example, prime a liquid delivery device, and/or in which the supply of liquid can be provided at a controlled pressure to a liquid ejection location. The liquid may have solid particles suspended or dispersed within it or have other additives added to it, but in all cases the end result is a fluid that behaves substantially like a liquid. Further, the present invention relates to a liquid management system for supplying or receiving liquid comprising heavily sedimenting particles, such as glass frit and/or ink pigment or other solids not well dispersed in the liquid.

In various liquid delivery devices such as inkjet printers or spray heads, it is necessary to achieve a consistent ejection of liquid from the liquid delivery device and/or in order to do so, precise control of the static pressure of liquid is required at the ejection location. Precise control of the liquid flow may also be required. Printheads of the type requiring the properties above are described in EP 1224079 and EP 1366901, for example. Other devices which have similar requirements are disclosed in, for example, EP1071559. EP 2076395 teaches that the pressures at the printhead described in EP 1224079 and EP 1366901 need to be corrected to about + or −20 Pa and those periodic variations must be below about + or −2 Pa to eliminate visible variations in print quality. Likewise, printheads of other designs will be able to tolerate pressure fluctuations (and fluid flow rates) dependant upon their design.

A simple method of controlling the pressure of the liquid supply to a liquid delivery device, such as a printhead, is to use gravity. A liquid reservoir, whereby the surface of the liquid is open to atmospheric pressure, is mounted either above or below the level of the printhead in order to generate a positive or negative liquid pressure, as required by the printhead. The required inlet pressure in the ejection location can be set by mechanically adjusting the relative height of the liquid reservoir with respect to the printhead. The reservoir may also be supplied with liquid by a pump.

Some liquid delivery devices require ink to flow continuously through the device and this requires the device to have both an inlet and outlet to allow ink to flow in and out of the device. In these devices, the pressure of the ink at this outlet can also be controlled by gravity by allowing ink to flow to atmospheric pressure from the outlet tube to a defined level below the printhead. This level can also be mechanically adjusted to achieve the correct operating conditions (such as ink pressure and flow rate) at the ejection location.

As described in EP 2076395, known disadvantages of a gravity-fed ink supply system (which can be generalised to a liquid supply system) are:

- Changing the pressures requires physical movement of the reservoirs.
- The location of the reservoirs is determined by the required pressures.

- A large volume of space may be required to accommodate the total adjustable range of the reservoirs.
- Priming printheads with ink can be assisted by supplying ink at pressures that are very different from the pressures required during printing.
- With a gravity fed system a large amount of space and typically a significant amount time is required to move the reservoirs to achieve these pressures.
- The surface of the ink must be open to the atmosphere, increasing the risk of dust or other contaminates polluting the ink.

WO 97/441914 and EP 1092548 each describe ink supply systems in which the ink surface is maintained at a constant level or height in the reservoir by use of a weir. Such a system is also described in WO 2006/030235. Such systems can either use gravity to set the pressure of the ejection location or, in the case of WO 2006/030235, the pressure of the ink at the inlet and outlet of a nozzle containing fluid supply apparatus is controlled by controlling the pressure of air above or with air at the inlet and the outlet from the nozzle containing fluid supply apparatus. In order to maintain the functioning weir it is necessary to remove the ink that has flowed over the weir from the reservoir.

EP 2076395 describes a further system in which the ink is maintained at a constant height in the reservoir by use of a weir. In this system, ink is pumped continuously from a remote ink tank to two reservoirs, one placed just before the printhead in the fluidic circuit and one just after. The pressure of the fluid in the reservoirs is controlled such that the ink flows through the printhead at a controllable pressure and flow rate.

In EP 2076395, it is claimed that it is convenient to measure the pressure in the local reservoir by using a gas pressure sensor mounted above the ink level in the reservoir. Therefore, to control the pressure of the ink in the reservoir based on this pressure management, it is important that the depth of the ink in the reservoirs is kept constant.

EP 2076395 uses a weir over which the excess ink pumped into the reservoir flows in order to keep the fluid at a constant height on at the upstream side of the weir. The fluidic path to and from the printhead comes from this ink stored at the upstream side of the weir. The ink that flows over the weir is pumped back to the remote ink tank via a return pump. This return pump is over driven, such that it sucks some air in addition to ink out of the reservoir, thus creating a slight vacuum in the reservoir. The gas pressure sensor and proportional valve are operated in a feedback loop in order to let air leak into the reservoir (usually at atmospheric pressure from outside the reservoir, or alternatively from a positive or negative pressure reservoir) at a rate sufficient to enable the fluidic pressure in the reservoir to stabilise at a user controllable set pressure.

However, when using liquids which comprise heavily sedimenting or poorly dispersed particulates, such a system described in EP 2076395 has a number of drawbacks. These include:

- the presence of a weir (especially in the configuration shown in EP 2076395) creates a flow pattern that leads to areas where the flow of liquid is sufficiently low to allow the particles in the liquid to start falling out of suspension. This changes the composition of the liquid such that the liquid delivered to the head is different from that desired. The sediment may also start to fill the reservoir, disrupting or blocking the fluid flow.
- A heavily sedimenting liquid typically requires a higher flow rate than non-sedimenting liquid through the printhead and local reservoirs so as to prevent sedimentation when liquid is supplied to a system such as that in EP 2076395, turbulence is created in the reservoir such that the height of the liquid surface above the bottom of the reservoir becomes unstable. Turbulence itself also causes unpredictable variations in fluidic pressure. This in turn causes the pressure of the liquid supplied to head to fluctuate and become difficult to control, even with the feedback system described above.

The present invention addresses one or more of the problems identified above.

SUMMARY

According to the present invention, there is provided, a liquid management system for supplying or receiving liquid at a controlled pressure, comprising:

a closed reservoir having an inlet for receiving liquid from a first remote location and an outlet for supplying liquid to a second remote location; and a pumped outlet disposed in the reservoir and arranged to remove liquid and gas contained within the reservoir, the pumped outlet being disposed such that the level of liquid in the reservoir can be maintained at a constant height.

The pumped outlet may include a tube which extends into the reservoir. The tube may be substantially horizontal or substantially vertical within the reservoir. The tube may have a tapered opening within the reservoir. The pumped outlet may be an opening in a side wall of the reservoir. The inlet may be located above or below the pumped outlet depending upon the requirements of the system.

Means may be provided for controlling a pump attached to the pumped outlet such that the pressure within the reservoir is controlled. The system may further comprise an additional pump arranged, in use, to pump gas into or out of the reservoir. Means for controlling the additional pump may be provided such that the pressure within the reservoir is controlled.

An orifice may connect the reservoir to a gas at above, below, or at atmospheric pressure configured to bleed gas, in use, into or out of the reservoir. Means may be provided for controlling the orifice such that the pressure within the reservoir is controlled.

The height of the pumped outlet may be fixed or may be variable.

A liquid delivery system may include a liquid management system as described above and may further include a liquid delivery device supplied with liquid from the liquid management system.

The liquid delivery device may be a printhead or a sprayhead or another liquid delivery device.

The liquid delivery device may be the first or the second remote location.

A liquid delivery system may include two liquid management systems as described above, wherein one system supplies liquid to a liquid delivery device and the other system receives liquid from the liquid delivery device, thereby controlling the pressure of the liquid supplied to the liquid delivery device and the pressure of the liquid removed from the liquid delivery device, such that the liquid flows through the liquid delivery device at a controlled rate and at a controlled pressure.

In a further aspect, the present invention provides a liquid management system for supplying or receiving liquid at a controlled pressure comprising:

a reservoir having an inlet for receiving liquid from a first remote location and an outlet for removing liquid from the reservoir, the reservoir having a sloped bottom surface defining, at the lower end thereof, an apex, the inlet or the outlet being located adjacent the apex.

The inlet may be located adjacent the apex. The inlet may be pumped to supply liquid into the reservoir. The reservoir may be an open or a closed reservoir.

The outlet may be a pumped outlet to a second remote location. The pumped outlet may be at a fixed height within the reservoir. The outlet may be located adjacent the apex.

The system may further comprise a re-circulating fluid system connected to the outlet for re-circulating fluid back into the reservoir.

A liquid extraction outlet may be provided for supplying liquid to a second remote location.

The reservoir may include at least two chambers. One or more of the chambers may have a sloped bottom surface.

In another aspect, the present invention provides a liquid management system for supplying or receiving liquid at the controlled pressure comprising:

a reservoir having an inlet for receiving liquid from a first remote location and an outlet for supplying liquid to a second remote location; and at least one baffle located between the inlet and the outlet in the reservoir for breaking up the inlet flow.

The baffle may comprise one or more sloped surfaces. A plurality of baffles may be provided. The plurality of baffles may be in a substantially planar array or may be in a staggered arrangement. The plurality of baffles may be provided in two or more rows.

A pumped outlet may be provided from the reservoir, the pumped outlet being disposed such that the level of the liquid in the reservoir can be maintained at a constant height.

The uppermost part of one or more of the baffles may be located below the pumped outlet.

The skilled person would readily appreciate that features of the different aspects of the invention could be combined, even if not explicitly recited. For example, the sloped bottom to the reservoir could be incorporated in a system with baffles or in a system with a fixed height pumped outlet, or indeed the baffles could be incorporated into the fixed height pumped outlet arrangement as well. As such, unless otherwise explicitly excluded, any of the preferred features of any aspect of the invention disclosed herein can be incorporated into any of the separate aspects of the invention.

BRIEF DESCRIPTION OF THE DRAWINGS

Various examples will now be described with reference to the accompanying drawings in which.

DETAILED DESCRIPTION

Figure 1:
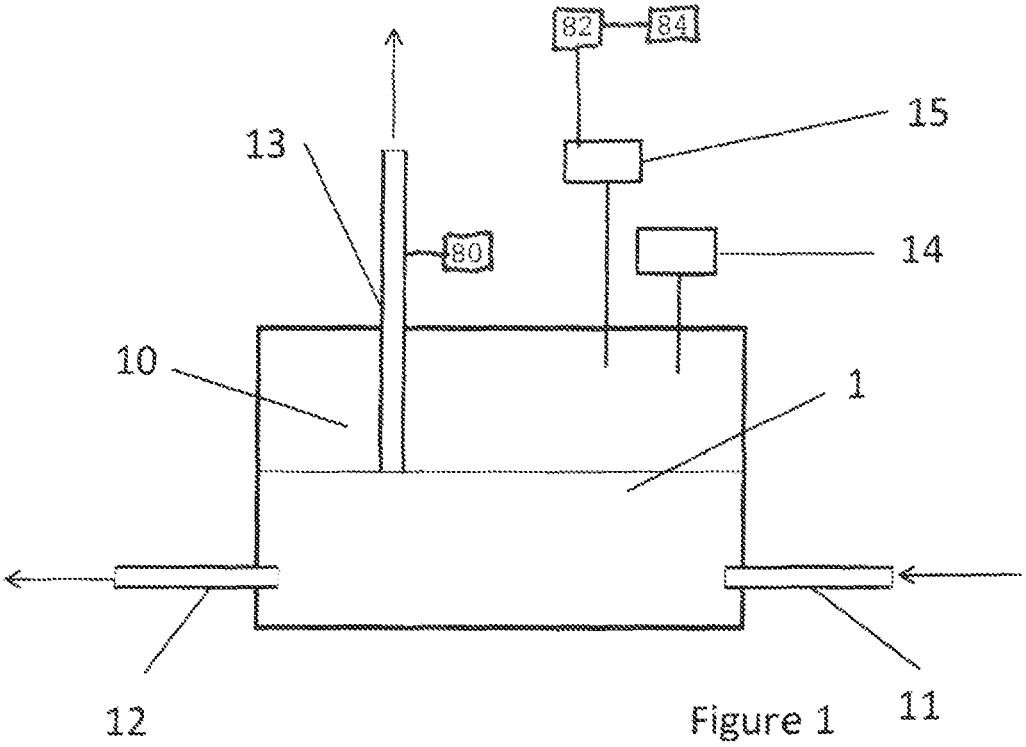
FIG. 1 is a schematic cross-section of one example of a system.

FIG. 1 shows a liquid reservoir 10 which is supplied with liquid 1 from a remote location (not shown) through an inlet pipe 11. Liquid exits the reservoir via an outlet pipe 12 to a liquid delivery device (not shown). In this example, the liquid delivery device could be a printhead, in which case the liquid is typically an ink, a sprayhead, in which case the liquid could be any suitable sprayable liquid, or any other aerosolising liquid delivery device. The liquid is typically a suspension in which sedimenting or poorly dispersed particles are included, although this is not a requirement.

The reservoir is provided with a further outlet 13. The outlet 13 is a pumped outlet which is disposed at a fixed height within the reservoir. The outlet 13 is connected to a pump 80 such that, when the pump is operational, excess liquid and/or air from the reservoir 10 is drawn through the outlet 13 and removed from the reservoir 10. In this way, the outlet 13 ensures that the height of the liquid 1 in the reservoir 10 remains constant, as the height can never be above the outlet 13. Whilst in the preferred example the outlet 13 is at a fixed height, it is conceivable that the height of this outlet could be variable, such that the user can define the height of fluid within the reservoir 10. Such a variation would typically be only carried out prior to use, so, as to set the parameters of the system.

The air pressure in the reservoir 10 above the surface of the liquid is also controlled and can be measured by, a pressure sensor 14. Alternatively and/or additionally, a liquid pressure sensor could be employed. Air can either be bleed into or out of the reservoir 10 through bleed valve 15, which can be supplied with air at any given pressure or it can be pumped in or out of the reservoir by an additional pump 82. The air pressure above the surface of the liquid can be controlled and set at a desired set point by controlled electronics or programmed via a computer, both of which are generally shown schematically in the Figures as an additional pump controller 84. Although air is described in this example, any other suitable gas could be used.

The reservoir can be configured such that the air pump (not shown) is not required to control the air pressure above the surface of the liquid. In this example, the rate of pumping from the outlet 13 is greater than the rate at which liquid is supplied into the reservoir 10 and therefore both liquid and air will always be pumped out of the reservoir 10. This will reduce the pressure of air in the reservoir 10 and this can then be controlled by bleeding air through the air bleed valve 15 into the reservoir 10 in order to maintain the pressure at the desired set point. The pump connected to the pumped outlet 13 returns the excess liquid back to a main liquid reservoir (not shown) which can then be used to supply liquid to inlet 11.

Figure 2:
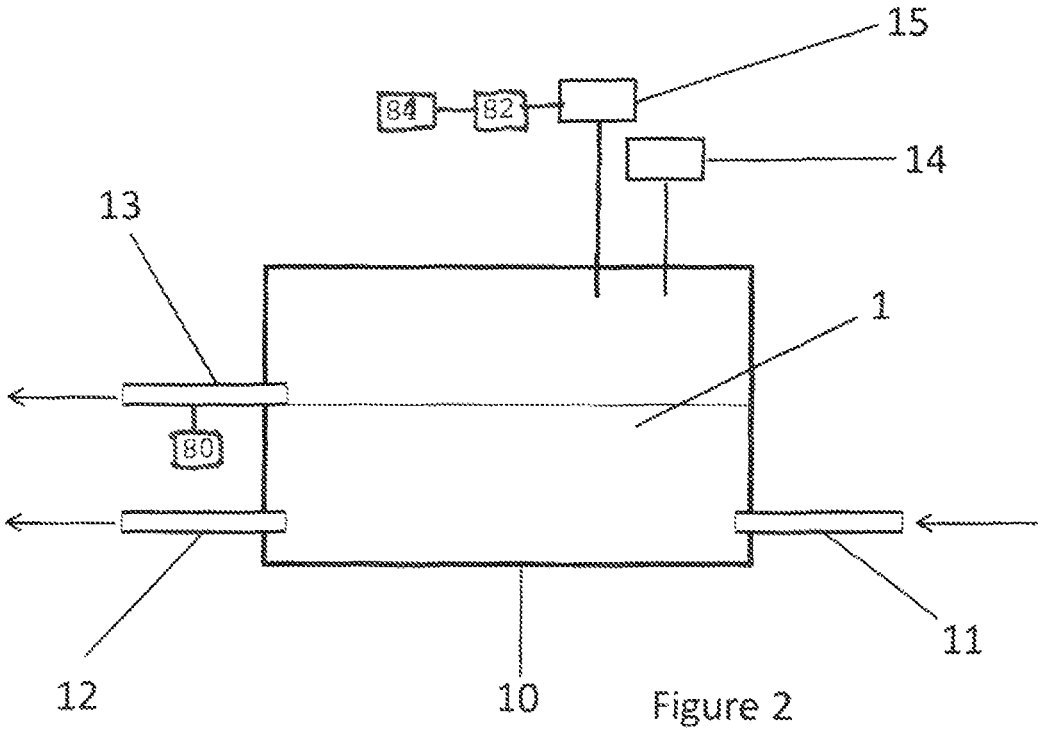
FIG. 2 shows a cross-section view of a further example of a system.
Figure 3:
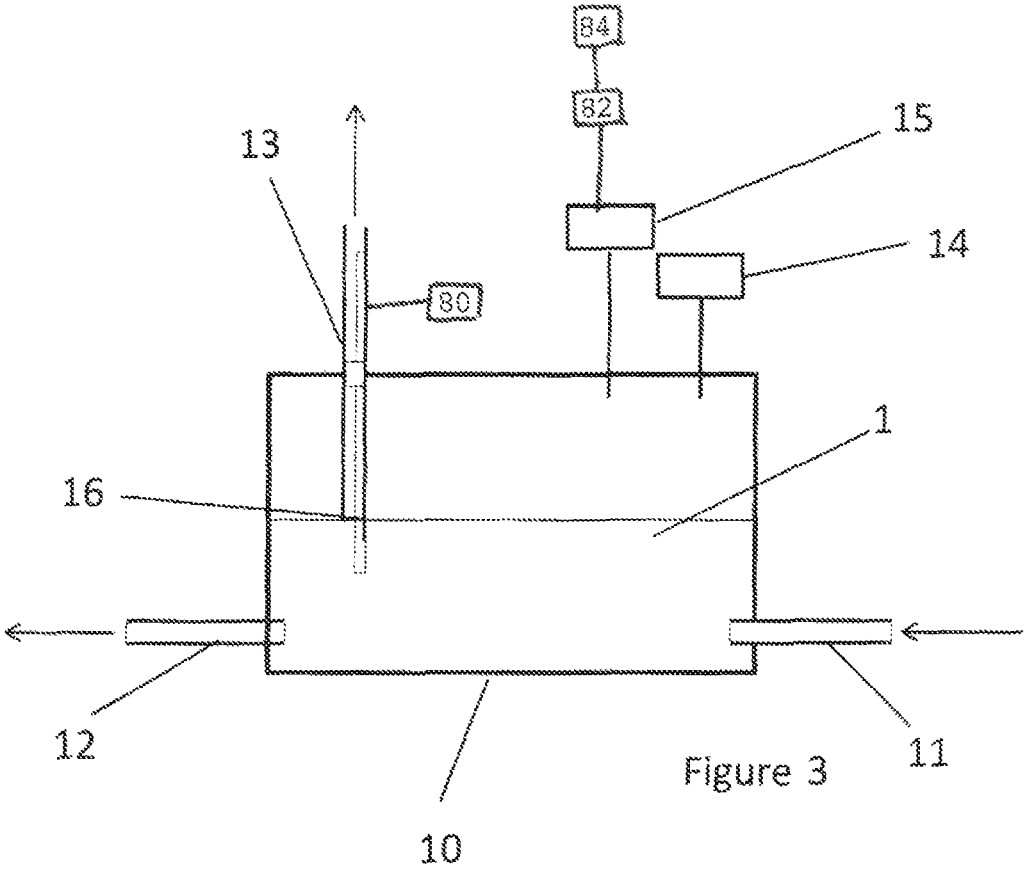
FIG. 3 shows a variation on the arrangement shown in FIG. 1.

An alternative example is shown in FIG. 2 in which the vertically aligned outlet 13 from FIG. 1 is replaced by a fixed height outlet located in a side wall of the reservoir 10. The outlet, which may take the form of a tube, may extend into the first reservoir 10 or may simply be an opening in the side wall. In this arrangement, the height of the outlet is fixed and cannot be varied. A further example, of the system of FIG. 1 is shown in FIG. 3, which is identical save for the lower end of the outlet 13. In this example, the lower end of the outlet 13 has been cut away on a diagonal 16, thereby creating a tapered opening. Such a tapered opening reduces pressure fluctuations caused by fluid pinning to the tube opening. In this arrangement, the height of the fluid is defined by the highest portion of the cut away at the end of the outlet tube.

In all three systems shown in FIGS. 1 to 3, the inlet 11 is shown below the surface of the liquid 1. This can be advantageous if it is desired to prevent turbulence that causes pressure fluctuations and bubble formation in a fluid. Alternatively, given the particular use of the invention, with liquids that have heavily sedimenting or poorly dispersed particles therein, it may be advantageous for the inlet to be located above the height of the liquid, such that the flow of liquid into the reservoir promotes mixing of the liquid that keeps the particles suspended. The optimum location for the inlet will be dependent upon the flow rate and subsequent level of turbulence and surface disruption and therefore the amount of pressure control that is required by the system.

Figure 4:
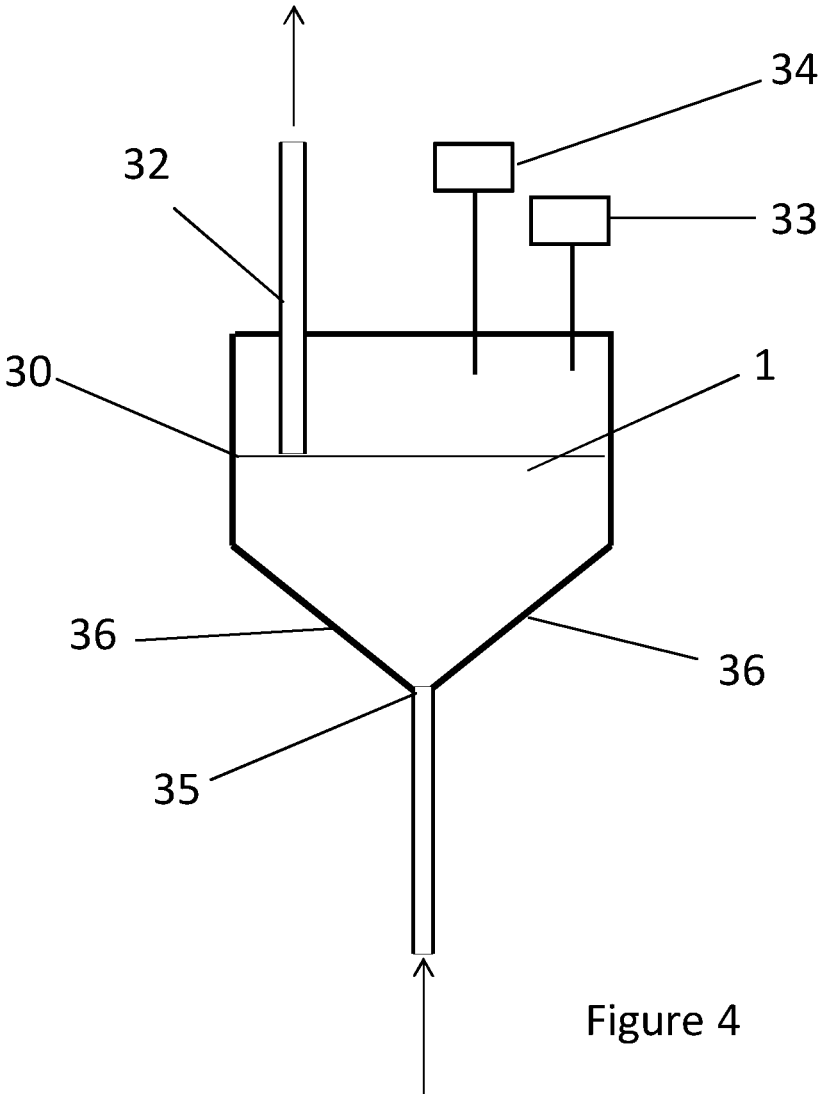
FIG. 4 shows a further example of a system having a sloped bottom to the reservoir.

A further example is shown in FIG. 4 having a reservoir 30, an inlet 31 and a pumped outlet 32. An outlet to the remote location, such as a printhead or sprayhead, is not shown, but is contemplated. Further inlets may also be provided. The pumped outlet 32 is shown in a similar manner to that of FIG. 1, but it can, alternatively, take the configuration shown in either FIG. 2 or FIG. 3. Again, an air pressure sensor 33 and proportional bleed valve 34 are provided for the same purposes as described in relation to FIG. 1.

Figure 4A:
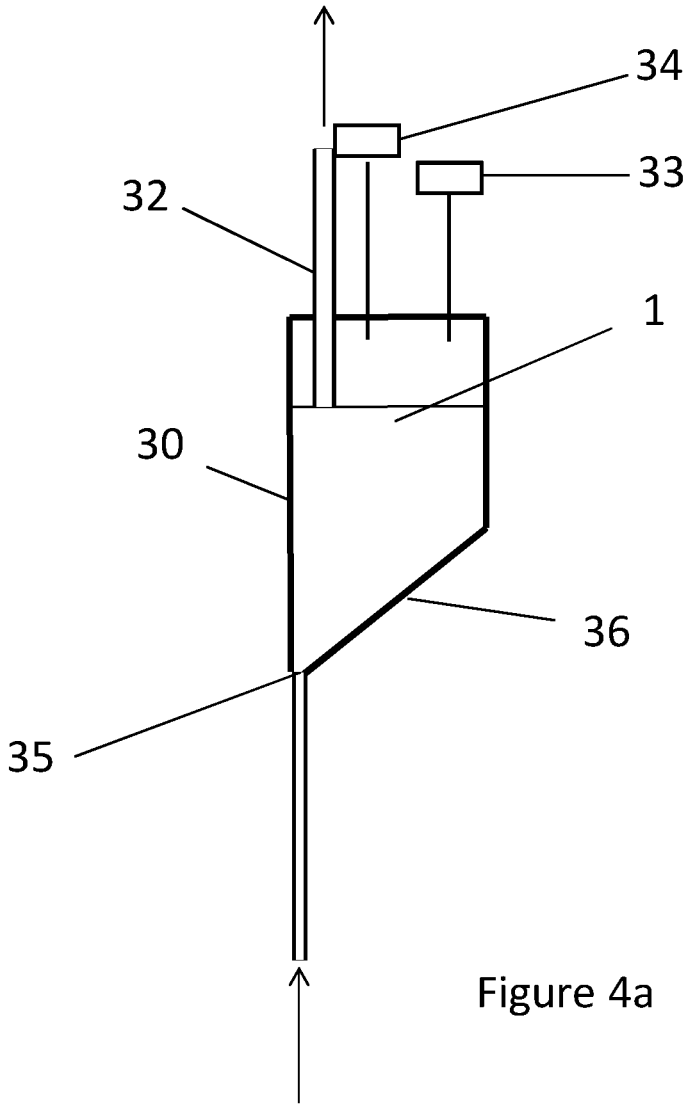
FIG. 4*a* shows another example of a system having a sloped bottom surface.

In this example, the lower surface 36 of the reservoir is sloped to define an apex 35 at which the inlet 31 is located. The sloped surface of the reservoir may take the form of a cone or pyramid, but may also take the form shown in FIG. 4*a* in which the lower surface 36 is either a simple slope, i.e. planar surface which is angled relative to the horizontal, or alternatively a v-section channel which directs any sedimenting or poorly dispersed particles to an apex. The reservoir is typically circular or square in cross section, although other cross sections are possible.

By virtue of the arrangement shown any sediment that does fall out of suspension drops towards the inlet 31 under gravity, at which point the sediment can be captured and re-suspended by the inlet flow, ensuring that the liquid composition remains constant in the bulk of the reservoir.

Figure 5:
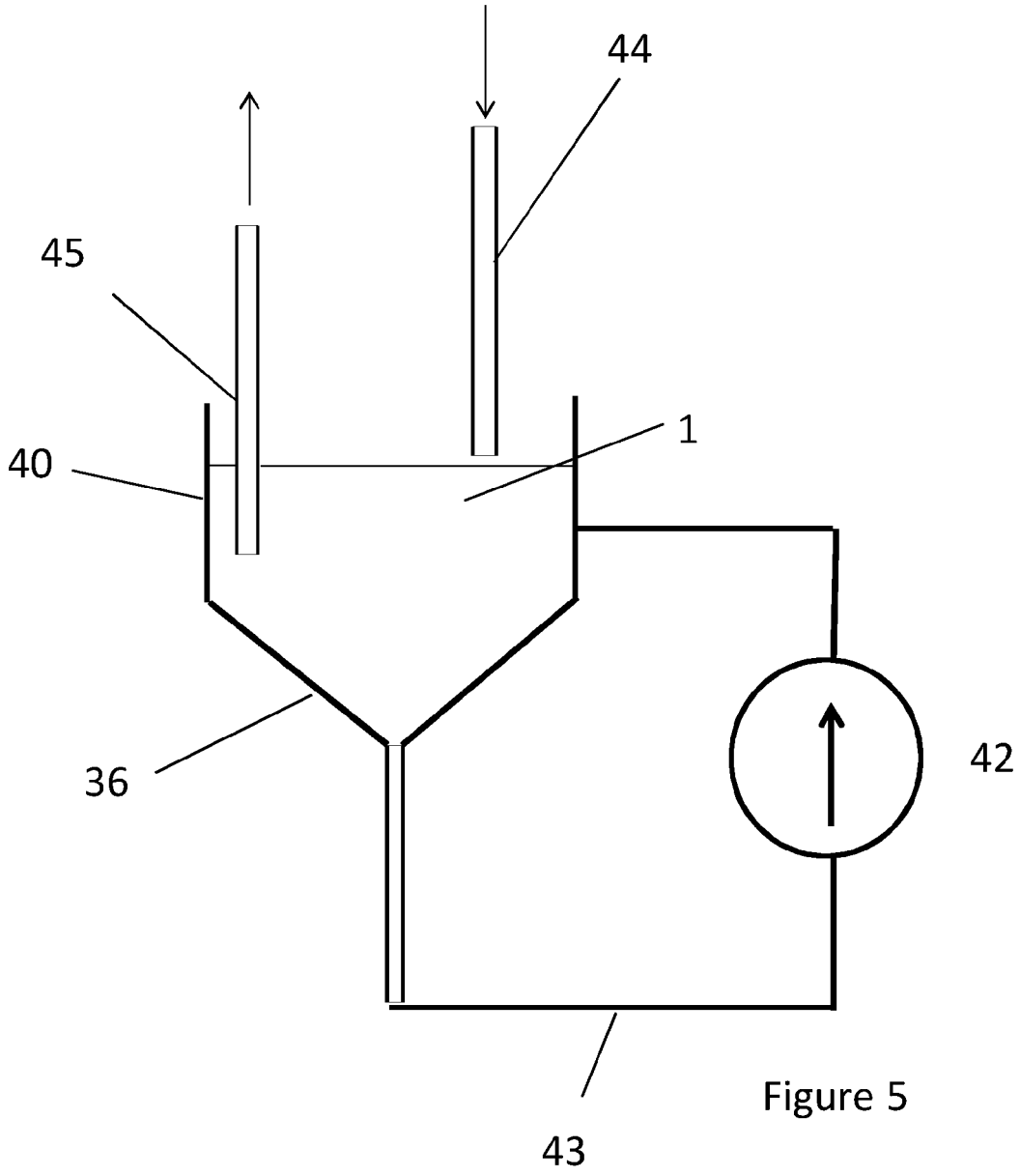
FIG. 5 shows a variation on the arrangement of FIG. 4.

An alternative configuration is shown in FIG. 5 in which the reservoir 40 is open and, whilst a sloped bottom 36 is provided in accordance with any of the variations discussed above, the apex 35 is provided with an inlet 41 which connects to a pump 42 and a re-circulating fluid system 43. A liquid supply line 44 is provided to supply liquid into the reservoir from a remote location. This may be above the level of the liquid as shown, or may be below as in other examples disclosed herein. The reservoir is provided with a liquid outlet 45 through which liquid is supplied to a remote location.

The arrangement shown in FIG. 5 helps to keep the particles in suspension by capturing and re-circulating any particles that sediment at the bottom and by creating further agitation in the main tank at the point of return of the flow into the reservoir. Also, the liquid supplied through supply line 44 causes the bulk fluid in the reservoir to become agitated.

Figure 6:
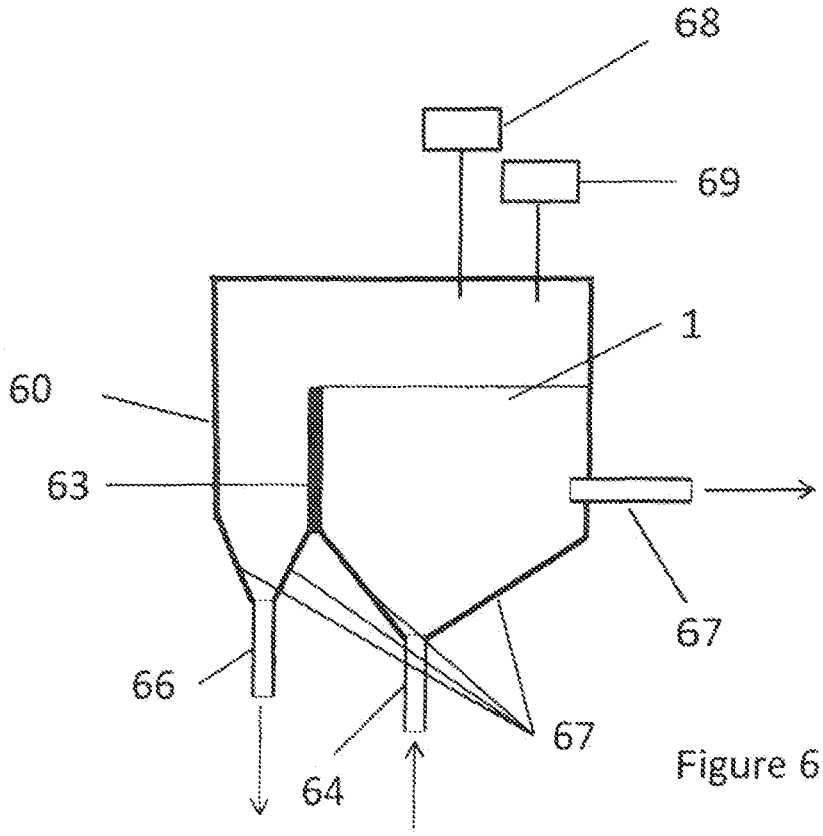
FIG. 6 shows an example of a system utilising both a weir and sloped reservoir bottom.
Figure 7:
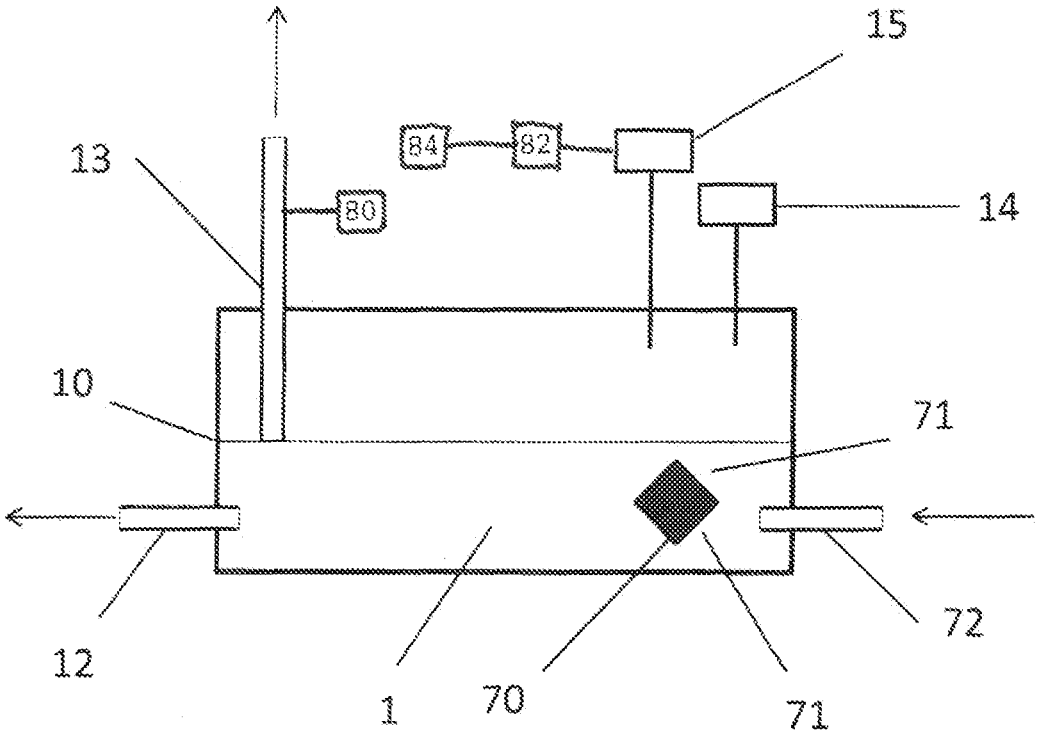
FIG. 7 shows a further example of a system using a baffle.

The provision of one or more sloped bottoms to a reservoir can be applied, as shown in FIG. 6, to an arrangement similar to that disclosed in EP 2076395. In this case, one or each chamber of the reservoir 60, separated by weir 63 can be provided with a sloped bottom 67 having any of the forms described above. The system has a first chamber 61 and a second chamber 62 and the first chamber 61 is provided with an inlet 64 located at the apex of the bottom of the first chamber and an outlet 65. The second chamber 62 is provided with a pumped outlet 66 at the apex of the sloped bottom of the second chamber 62. Bleed valve 68 and pressure sensor 69 are provided as in the other examples A further example is shown in FIG. 7 which is, for the purposes of the description, the same system as that shown in FIG. 1. The only difference is the provision of a baffle 70 in the reservoir 10. However, the use of one or more baffles could be employed in any of the configurations described above. One or more baffles may be provided and they may be provided in any suitable configuration. The purpose of the baffles is to prevent any liquid that may form splashes from impacting on the pressure sensors and proportional valves placed in the reservoir as part of the pressure control apparatus, to break up the flow and to divert it such that any turbulence has minimal effect on the surface of the liquid and therefore the depth of the liquid from the reservoir, and also to smoothly separate the relatively high velocity liquid emerging from the liquid supply to the reservoir. One or more of these advantages may be achieved depending upon the particular configuration of the system and the location or locations of the or each baffle.

As can be seen in FIG. 7, the baffle is provided with sloped surfaces 71 which assist disrupting the flow through inlet 72 such that turbulence is created. Further, it discourages any sediment from accumulating on the top surfaces. The location of the or each baffle is important so as to ensure that static regions of the flow are not created, for example, eddys or other regions of low flow, which might mean that heavier particles could start to fall out of suspension, thereby affecting the composition of the liquid supplied from the reservoir.

Further features may be applicable to any or all of the examples described. These include:

A filter placed in line with the re-circulating fluid of either the main reservoir in the supply or return line so as to continuously remove any unwanted particles from the liquid.

The pump selection is very important. The pumped overflow design only works with pumps that can pump gas and liquid simultaneously, such as positive displacement pumps, but many of these are very pulsatile, such as diaphragm pumps or peristaltic pumps. Many pumps exhibit relatively low pulsatility cannot handle sedimenting fluids very easily, such as gear pumps. Therefore, in order to pump sedimenting fluids, it may be necessary to select a pulsatile pump and create fluidic damping in a system to aid the active feedback pressure compensation that is present. This can include the use of dampers designed specifically for the pump by the manufacturer, or other well known passive dampening techniques such as increasing the volume of air above the fluid in the reservoirs.

It is typically advantageous to use a pinch valve with sedimenting liquids, as this minimises the chance of the particulates interfering with or damaging the operation of a valve.

Reversing the pump supplying fluid into the main reservoir may allow the system to be drain efficiently allowing the majority of liquid to be recovered to the main reservoir.

The invention claimed is:

1. A liquid management system for supplying or receiving liquid at a controlled pressure, comprising:

a closed single-chamber reservoir having an inlet for receiving liquid from a first remote location and an outlet for supplying liquid to a second remote location; and a liquid and gas pump in communication with a pumped outlet disposed in the closed single-chamber reservoir at a height, the liquid and gas pump being arranged to remove the liquid and gas at the height of the pumped outlet thereby maintaining a single constant level of the liquid across the entire closed single-chamber reservoir at the height of the pumped outlet.

2. A system according to claim 1, wherein the pumped outlet includes a tube which extends into the reservoir.

3. A system according to claim 2, wherein the tube is substantially horizontal.

4. A system according to claim 2, wherein the tube is substantially vertical within the reservoir.

5. A system according to claim 2, wherein the tube has a tapered opening within the reservoir.

6. A system according to claim 1, wherein the pumped outlet is an opening in a side wall of the reservoir.

7. A system according to claim 1, further comprising a pump attached to the pumped outlet, the pump configured to control air pressure within the closed single-chamber reservoir.

8. A system according to claim 1, wherein the system further comprises an additional pump arranged to pump gas into or out of the closed single-chamber reservoir through an orifice in the closed single-chamber reservoir.

9. A system according to claim 8, further comprising an additional pump controller.

10. A system according to claim 1, further comprising an orifice connecting the reservoir to a gas at above, below, or at atmospheric pressure configured to bleed gas, in use, into or out of the reservoir.

11. A system according to claim 10, further comprising means for controlling the orifice such that the pressure within the reservoir is controlled.

12. A system according to claim 1, wherein the height of the pumped outlet is variable.

13. A liquid delivery system including a liquid management system according to claim 1 and including a liquid delivery device supplied with liquid from the liquid management system.

14. A system according to claim 13, wherein the liquid delivery device is a printhead.

15. A system according to claim 13, wherein the liquid delivery device is a sprayhead.

16. A system according to claim 13, wherein the liquid delivery device is the first remote location.

17. A system printer according to claim 13, wherein the liquid delivery device is the second remote location.

18. A liquid delivery system including two liquid management systems according to claim 1 wherein one system supplies liquid to a liquid delivery device and the other system receives liquid from the liquid delivery device, thereby controlling the pressure of the liquid supplied to the liquid delivery device and the pressure of the liquid removed from the liquid delivery device, such that the liquid flows through the liquid delivery device at a controlled rate and at a controlled pressure.

19. The liquid management system of claim 1, wherein the pumped outlet is disposed at a greater height than the height of the outlet.

20. A liquid management system for supplying or receiving liquid at a controlled pressure, comprising:

a closed single-chamber reservoir comprising an inlet for receiving liquid from a first remote location and an outlet for supplying liquid to a second remote location, the closed single-chamber reservoir defining a volume for holding liquid in fluid communication with the outlet; and a liquid and gas pump in communication with a pumped outlet disposed in the closed single-chamber reservoir at a first height, the liquid and gas pump being arranged to remove the liquid and gas at the first height of the pumped outlet, thereby maintaining a level of the liquid in the closed single-chamber reservoir at the first height of the pumped outlet, wherein the first height is greater than the height of the outlet and thus defines the depth, at the outlet, of the liquid in fluid communication with the outlet.

* * * * *